US009138636B2

(12) United States Patent
Horovitz

(10) Patent No.: US 9,138,636 B2
(45) Date of Patent: Sep. 22, 2015

(54) SYSTEM AND METHOD FOR CALCULATING VALUES IN TILE GAMES

(75) Inventor: Ronen Horovitz, West Hills, CA (US)

(73) Assignee: EYECUE VISION TECHNOLOGIES LTD., Yokneam (IL)

( * ) Notice: Subject to any disclaimer, the term of this patent is extended or adjusted under 35 U.S.C. 154(b) by 513 days.

(21) Appl. No.: 13/490,467

(22) Filed: Jun. 7, 2012

(65) Prior Publication Data

US 2012/0244922 A1 Sep. 27, 2012

Related U.S. Application Data

(63) Continuation-in-part of application No. 12/600,293, filed as application No. PCT/IL2008/000675 on May 18, 2008, now Pat. No. 8,210,945, application No. 13/490,467, which is a continuation-in-part of application No. 13/201,512, filed as application No. PCT/US2010/044343 on Aug. 4, 2010.

(60) Provisional application No. 60/924,463, filed on May 16, 2007, provisional application No. 61/231,216, filed on Aug. 4, 2009.

(51) Int. Cl.

| | |
|---|---|
| ***H04N 7/18*** | (2006.01) |
| ***G06F 17/00*** | (2006.01) |
| ***A63F 3/04*** | (2006.01) |
| ***A63F 11/00*** | (2006.01) |
| ***A63F 3/00*** | (2006.01) |
| *A63F 9/24* | (2006.01) |

(52) U.S. Cl.

CPC ..... *A63F 3/0423* (2013.01); *A63F 3/00643* (2013.01); *A63F 11/0051* (2013.01); *A63F 2003/0428* (2013.01); *A63F 2009/2435* (2013.01); *A63F 2011/0058* (2013.01)

(58) Field of Classification Search

USPC ..... 463/2–6, 30–36, 11–13; 348/143

See application file for complete search history.

(56) References Cited

U.S. PATENT DOCUMENTS

| | | | | |
|---|---|---|---|---|
| 5,855,483 | A | 1/1999 | Collins et al. | |
| 6,049,281 | A | 4/2000 | Osterweil | |
| 6,690,156 | B1 | 2/2004 | Weiner et al. | |
| 6,745,236 | B1 | 6/2004 | Hawkins et al. | |
| 6,967,566 | B2 | 11/2005 | Weston et al. | |
| 7,051,935 | B2 | 5/2006 | Sali et al. | |
| 7,720,257 | B2 | 5/2010 | Morellas et al. | |
| 8,167,721 | B2 * | 5/2012 | Fujisawa | 463/36 |
| 2006/0083423 | A1 | 4/2006 | Brown et al. | |
| 2006/0125691 | A1 | 6/2006 | Menache et al. | |
| 2006/0136180 | A1 | 6/2006 | Hansen et al. | |
| 2006/0258446 | A1 | 11/2006 | Nguyen et al. | |
| 2007/0262984 | A1 | 11/2007 | Pruss | |
| 2008/0004093 | A1 | 1/2008 | Van Luchene et al. | |
| 2011/0193990 | A1 | 8/2011 | Pillman et al. | |
| 2011/0300516 | A1 * | 12/2011 | Wigdor et al. | 434/116 |
| 2013/0190087 | A1 * | 7/2013 | Somarajapuram | 463/32 |
| 2013/0217491 | A1 * | 8/2013 | Hilbert et al. | 463/31 |

* cited by examiner

*Primary Examiner* — Ronald Laneau

(74) *Attorney, Agent, or Firm* — Pearl Cohen Zedek Latzer Baratz LLP

(57) ABSTRACT

A system and method for capturing images of a game space, detecting word or letter tiles added to the game space by a player, calculating a value of the added words or letters and adding the value to the score of the player during whose turn the letters or words were added.

9 Claims, 2 Drawing Sheets

SYSTEM AND METHOD FOR CALCULATING VALUES IN TILE GAMES

CROSS REFERENCE TO RELATED APPLICATION

This application is (i) a continuation in part of U.S. application Ser. No. 12/600,293, filed on Nov. 16, 2009 now U.S. Pat. No. 8,210,945, entitled "SYSTEM AND METHOD FOR PHYSICALLY INTERACTIVE BOARD GAMES" which is a US National Phase Application of PCT International Application PCT/IL2008/000675, International Filing Date May 18, 2008, which claimed priority from U.S. Provisional Application No. 60/924,463, filed on May 16, 2007, and of (ii) a continuation in part of U.S. application Ser. No. 13/201,512, filed Aug. 15, 2011, entitled "SYSTEM AND METHOD FOR OBJECT EXTRACTION" which is a National Phase Application of PCT International Application No. PCT/US2010/044343, International Filing Date Aug. 4, 2010, published on Feb. 10, 2011, as International Publication No. WO 2011/017393, which claimed priority from Provisional Patent Application No. 61/231,216, filed on Aug. 4, 2009; all of which are incorporated herein by reference in their entirety.

FIELD OF THE INVENTION

The invention pertains generally to image recognition and interactive entertainment. More specifically, this application relates to using an imaging device to calculate a score in a word tile or letter tile game.

BACKGROUND OF THE INVENTION

Letter and word tile games are popular entertainment pastimes. Typically, players calculate and keep scores in such games with pegs or markers that may be provided with a game set or with pen and paper or in other simple ways. Determining a suitability of a word or sentence with the rules of the game may be done with a dictionary or other reference book.

SUMMARY OF THE INVENTION

Embodiments of the invention may include a system for interactive gaming, where such a system has an imager to capture a series of images of game tiles in a game space, a memory to store a value that is associated with one or more of the game tiles, and a processor to detect a first configuration of game tiles, such configuration including for example words, equations or other grouping of game tiles in a first of the images, and to detect a second configuration of game tiles in a second image. The processor may identify a difference between the configuration of words or tiles in the first image and a configuration of words or tiles in the second image. The processor may calculate a value of the difference of the configurations of words between the two images in accordance with the pre-defined values of the game tiles, and issue a signal indicating the value of the difference between the configurations of words in the first image and the configuration of words or tiles in the second image.

In some embodiments, the imager may capture the series of images of tiles that rest on a game board, and the processor may identify a position of such tiles relative to positions on the game board.

In some embodiments, the memory may store an indication of words such as a dictionary, and the processor may compare the words or configurations of tiles that are included in the difference between the configuration in the first image and the configuration in the second image with the stored words. The processor may issue a signal if one or more of the words does not match the words stored in the memory.

In some embodiments, a processor may add a value of the difference between the configurations in the two images to a value stored in the memory, and may associate a result of such adding with a user.

In some embodiments, the imager may capture an image of an item, such as a ring, bracelet, sleeve, skin color or other item, appearing in an image, and the processor may associate the item with a user. The processor may associate the value of the difference in configurations between the two images with the user and with a score of such user stored in a memory associated with such user.

In some embodiments, an imager may capture an image of other game tiles, such as those in reserve or in a hand of a player, and may compare a combination of (i) one or more of the other games tiles with (ii) a configuration of tiles on the game board to a list of words or configurations of tiles in a dictionary or compendium stored in a memory. The processor may issue a signal of a match of the comparison.

Some embodiments may include a method of automated scoring of a tile game, where the method includes capturing an image of a scene of a tile game; detecting from the image a tile that was added to the scene of the game during a turn of play; and calculating a value of the detected tile that was added to the scene, in accordance with rules of the game.

In some embodiments, detecting includes detecting a tile added to the scene during a particular turn of play; and calculating includes calculating a value of the tiles added to such scene. Such embodiment may also include comparing the tiles added to the scene during a turn of play to a stored compilation of combinations of tiles, and adding the value to a stored score of the player executing the turn of play.

In some embodiments, detecting may include capturing a first image of the tile game before a turn is taken by a player, and capturing a second image of the game after the turn is taken, and comparing a configuration of tiles in the first image with a configuration of tiles in the second image. Such image may include an image of the board of the game In some embodiments, calculating a value may include calculating the value as a function of the detected location of the tile on the board, so that if a tile is on a particular location of the board, the value of the tile may be multiplied by two or three, or may assume another value.

Some embodiments may include an imager to capture an image of a playing board on which are placed tiles, a memory to store a rule of play and an association of a tile with values; and a processor to identify a playing tile on the board in the image; associate the identified playing tile with a value; and calculate a value of the tile in accordance with a rule of play.

BRIEF DESCRIPTION OF THE DRAWINGS

Embodiments of the invention are illustrated by way of example and not limitation in the figures of the accompanying drawings, in which like reference numerals indicate corresponding, analogous or similar elements, and in which.

DETAILED DESCRIPTION OF THE PREFERRED EMBODIMENTS

Figure 1:
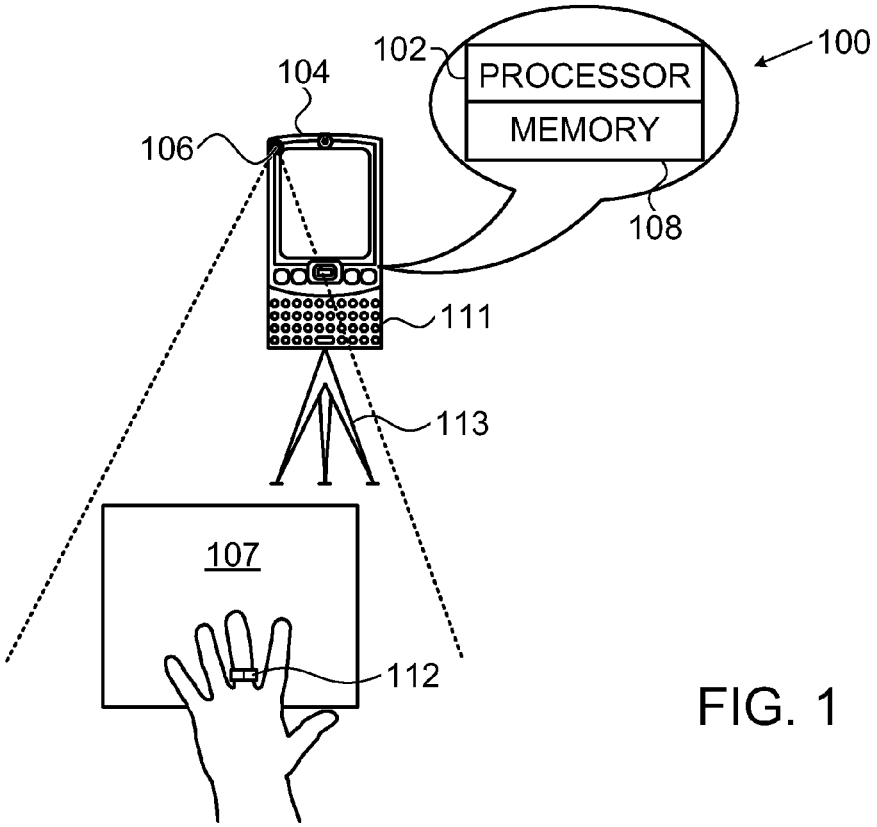
FIG. 1 is a conceptual illustration of a system in accordance with an embodiment of the invention.

In the following detailed description, numerous specific details are set forth in order to provide a thorough understanding of embodiments of the invention. However it will be understood by those of ordinary skill in the art that the embodiments of the invention may be practiced without these specific details. In other instances, well-known methods, procedures, and components have not been described in detail so as not to obscure the embodiments of the invention.

Unless specifically stated otherwise, as apparent from the following discussions, it is appreciated that throughout the specification, discussions utilizing terms such as "selecting," "evaluating," "processing," "computing," "calculating," "associating," "determining," "comparing", "combining" "designating," "allocating" or the like, refer to the actions and/or processes of a computer, computer processor or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

The processes and functions presented herein are not inherently related to any particular computer, network or other apparatus. Embodiments of the invention described herein are not described with reference to any particular programming language, machine code, etc. It will be appreciated that a variety of programming languages, network systems, protocols or hardware configurations may be used to implement the teachings of the embodiments of the invention as described herein. In some embodiments, one or more methods of embodiments of the invention may be stored on an article such as a memory device, where such instructions upon execution result in a method of an embodiment of the invention. In some embodiments, one or more components of a system may be associated with other components by way of a wired or wireless network. For example a memory and a processor may be in separate locations and connected by such a network.

As used in this application, and in addition to its regular meaning, the term game or interactive game may refer to a series of instructions, some of which may be executed by one or more players, by a processor or by a combination of players and a processor, whereupon such execution an action or response may be taken by another player, by the processor or by a combination of players and a processor. A game may also refer to a challenge or a series of challenges and responses taken by one or more participants, such as for example in the context of a card game, a word tile game, a letter game or other games. Some games may be played on a board having markings, instructions, or indications for a placement of a card, tile or other game pieces. A game may include the physical items used to play the game; for example a game may include the board and tiles. For example a Scrabble™ board may include a grid (typically on a board) surrounded by a frame, where such grid includes markings noting the spot where tiles or pieces may be placed, and where certain predefined spaces on the grid are marked with rules or values relating to the game and to tiles or words that are put on such spaces. Tiles may also have or be associated with pre-defined values. Such rules and values may be stored in a memory.

As used in this application, and in addition to their regular meanings, the terms word tile and letter tile may refer to playing pieces such as those made of wood, plastic, paper, cardboard or other materials, onto which are printed, etched or otherwise marked words or letters. Such tiles may be used in for example, mahjong, dominoes, the Scrabble™ game, the Boggle™ game, and various math, word, color or spelling games. Tiles may also include cards such as playing cards as may be used in games such as bridge, rummy, blackjack and others.

Reference is made to FIG. 1, a conceptual illustration of a system in accordance with an embodiment of the invention. In some embodiments, a system 100 may include a processor 102 as may be present in for example a personal computer, tablet computer, cell phone (cellular telephone), smart phone (smart telephone), game console or other electronic device, an electronic display 104 such as a television, cell phone screen, computer monitor or other display, a camera 106 (which may be an image capture mechanism or other imager such as for example a digital still or video camera, webcam or other imager). Processor 102 may be connected to, linked with or otherwise associated with, a memory 108 that may store for example one or more rules, values of time, or series of rules for an interactive game, a dictionary or other compendium of combinations of words, letters or cards, information about users or players in a game, and other information. Memory 108 may also store software or instructions which, when executed, result in the carrying out of methods according to the present invention. In some embodiments, one or more of processor 102, display 104, camera 106 and memory 108 may be housed in a single unit or housing 111 such as for example in the housing 111 of a smart phone. In some embodiments, housing 111 may be placed into stand 113 to direct a view of camera 106 towards an area of play of a game, such as towards a board upon which a game is to be played. In some embodiments, one or more players may wear or carry an object 112, such as a glove, ring, bracelet or other distinctive object that may be captured by camera 106 in an image and that may be associated in memory 108 with the player or user.

In some embodiments, display 104 may display one or more scenes 107 of a game, such as a game board or table upon which game tiles are placed, and may display one or more pieces, such as word or letter tiles or other representations of game pieces that may have been placed on such game board or in an area of play. For example, display 104 may show a backgammon board, where the red pieces represent a first player and black pieces represent a second player. Display 104 may show a Scrabble board with the representations of the letter tiles on the grid of the displayed board. In some embodiments, the board may not appear on the display 104. In some embodiments, assemblies or configurations of letter tiles making words or phrases that have been placed on the board may be displayed.

Figure 2:
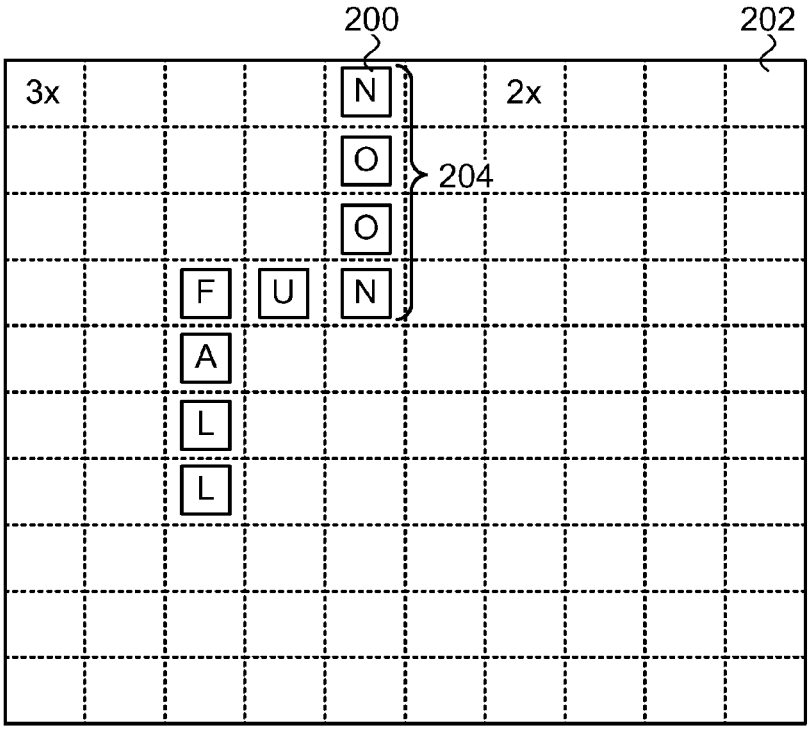
FIG. 2 is a schematic diagram of a Scrabble™ board onto which are placed letter tiles by a user, and a representation of the play on the board shown on a display, in accordance with an embodiment of the invention.

Reference is made to FIG. 2, a schematic diagram of a Scrabble board onto which are placed letter tiles by a user, and a representation of the play on the board shown on a display, in accordance with an embodiment of the invention. In operation, a player may perform an action such as for example placing letter tiles 200 onto a board 202 in a particular configuration to form a word 204 from such tiles 200. Camera 106 may capture an image or series of images of board 202 that may include an image captured before a new tile 200 or a series or configurations or tiles 200 was added to board 202. Another image of the board 202 may be captured after the new tiles 200 or word 204 was added to board 202. Processor 102 may compare the two images and detect the differences in tiles between the two images or the, changes or additional tiles 200 that appear or were placed on the board 202 during the period between the image from before and the image from after the tiles were added. In some embodiments, letters, symbols or other marks on the tiles may be detected in an image and recognized by associating the image with one of a series of stored images of letters or marks. A method and system of such detection and recognition is set out in PCT Application/IL2012/000023 filed on Jan. 16, 2012 and entitled System and Method of Identification of Printed Matter in an Image Processor, a copy of which is incorporated herein by reference. Processor 102 may isolate or identify the newly added tiles 200 or the difference between the tiles on the game space in the first image and the tiles on the game space in the second image, as well as the letters printed on tiles 200, and may associate such letters with values assigned to them in the game, as such values and rules may be stored in memory 108. For example, a value of a tile 200 with the letter E printed on it may be stored in memory 108 as 1, while a value of a tile 200 with the letter X may be stored in memory 108 as 8. Values may correspond to points according to the rules of the particular game. Processor 102 may calculate a value of such newly added tiles 200 and the words 204 that they form in accordance with rules of the game that were stored in memory 108. In some embodiments, a representation of the added letters, tiles 200 and words 204 may be presented on display 104. In some embodiments, a value of the added words 204 or letters (e.g., the score for a player's turn) may also appear on display 104, along with an indication such as by shading or coloring, as to which player added the tiles 200 or words 204.

Processor 102 may also detect the position or location of one or more of the tiles 200 on the board 202, and may apply the rules of the game to the tiles 200 that are associated with particular grid spaces or locations on the board where such pieces are determined to be located. For example, processor 102 may detect that a letter tile 200 is on a double letter space of the grid of board 202, and may store such information in memory 108.

The action or a move of a player may be captured by camera 106 in one or a series of images, and such action may be identified as being part of or associated with the player taking such action. For example, a player may register himself with processor 102 as taking his turn, by for example holding or shaking his arm or hand in view of camera 106 or taking some other pre-designated action with his hand in view of the camera 106. For example, when a player takes a turn or completes a move adding tiles 200 to the board 202, he may hold his hand up that may have object 112 on it, or may take some other action to register his turn at adding tiles 200 to board 202 or signal the completion of a move. An ending of a move or turn by a player may also be registered with processor 102 by a particular movement of the hand having object 112, such as a shake or making a fist, by the player whose turn finished. An image of the hand or arm as well as a color, structure or other characteristic of for example, object 112, skin, clothing, rings, bracelets or other items on the player's hand may be used to associate the hand with the player during the playing turn. Other actions may be used to signal the completion of or beginning of a move or turn.

Tiles 200 or words 202 added to the board 202 by the player during his turn may be attributed or associated by processor 102 with such player (e.g., a representation of the game status may be stored in memory 108), and the value or score of the words 204 or tiles 200 so added may be added to the existing score of the player as may have been stored in memory 108.

In some embodiments, a dictionary or other compilation of words, phrases or permitted configurations of tiles may be stored in memory 108, and processor 102 may compare words 204 that appear on board 202, to the stored dictionary to determine if the word 204 is permitted under the rules of the game. Processor 102 may issue a signal to indicate that the comparison successfully identified the added word 204, or alternatively that the word 204 is not acceptable if no successful comparison is found. For example, if the processor detects that a word, represented as a series of game tiles, has been added to a game space, it may compare the word to the list of words in a stored dictionary. If the comparison finds the added word to be the same as a permitted word in a dictionary, it may issue a signal to the players that the word is permitted and may signal a value of the added word in accordance with a rule of the game. If the comparison of the added word does not find a match to a permitted word in the dictionary, the processor may indicate that the word is not permitted or at least not recognized.]

In some embodiments, a first player may play on a board 202 or a screen in a first location, and a second player may play against the first player on a different board 202 or screen in a second geographic or physical location (e.g., not two locations on the same board). In such case, two or more cameras 106 and displays 104 may be used to concurrently indicate the status of play and of the board 204 in one or both of such locations.

In some embodiments, an imager may capture an image of letter tiles 200 that are not on board 204, but that are associated with a user, such as the tiles that have been picked by a user and that are available for play by the user, e.g., on a rack, in a player's area or in a player's hand. Processor 102 may compare words in a dictionary stored in memory 108, to a combination of one or more of such letter tiles 200 with one or more words 204 or letters on tiles hat are on board 202. Processor 102 may issue a signal to a user with a hint of possible uses on board 202 of one or more of his tiles 200.

Figure 3:
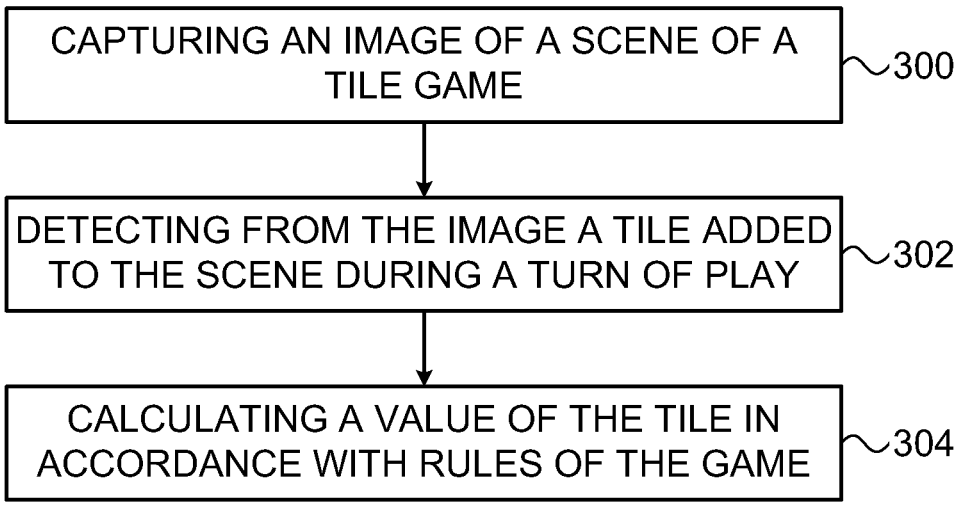
FIG. 3 is a flow diagram of a method in accordance with an embodiment of the invention.

Reference is made to FIG. 3, a flow diagram of a method of automated scoring of a tile game, in accordance with an embodiment of the invention. In block 300, a method may include capturing an image of a scene of a tile game where the scene includes for example the tiles that have been placed in play as part of the game. While in one embodiment, tiles are referred to, other games, not using tiles, may be used with a method according to the present invention. In general, such tiles that are in play exclude tiles that are for example still held in reserve by a player or in a 'kitty' or other reserve for later use. The scene may include for example a table, floor or other surface or area where tiles that are in play have been placed. For example, in a game such as the Bananagrams™ word game, a scene of a game may include one or more of the configurations of letter tiles that each player has already connected into words. An image may be captured by a camera, video camera, or other imager that may be held or suspended so that the playing area is in view of the images that it captures. For example, periodically, a person may use or manipulate a smart phone to image the game, or a smart phone may be positioned to continually view the game. In block 302, there may be detected in the captured image, one or more tiles that were added to the scene of play of the game during a turn of play. For example, an image of the scene or area of the game may show that one or more letter tiles were added to the scene or area of play during a player's turn of play. In block 304, a value or score may be calculated of the letter tiles that were detected as having been added to the playing scene during the turn of the player. The value may be calculated in accordance with rules of the game that may be stored in for example a memory. For example in Scrabble, each letter tile may be associated with a number of points, and a calculation of the points of the added tiles may be made. In dominoes, each tile may be associated with a number of points and the points of the dominoes added to the domino table during a player's turn may be calculated.

In some embodiments, more than one tile may be added to an area or scene of play during a player's turn, and the values of each of the added tiles may be calculated and added to the existing score of a player who had executed the turn and put the tiles into play in the scene, as such existing score may have been stored in for example a memory. Such score may be displayed for example on a screen that is visible to one or more players.

In some embodiments, detecting the tiles in the image that were added during the turn of play may include capturing or taking a series of images of the scene of play, where a first image is taken before the turn is played and the pieces are put down, and a second image is captured after the turn. A comparison of the configuration of tiles in the two images may be made, and the difference may be assumed to include the pieces put down in the turn. A value of the tiles added between two images, such as a value of the difference between the tiles or words in the first image and the tiles or words in the second image, may be assume to be the value of the score of the player whose turn was taken between the two images. A signal may be issued by the processor by way of for example a display screen, of the calculated score or pre-defined value of the tiles or pieces put onto the game space in the player's turn.

In some embodiments a scene of a game as captured in an image may include or even be limited to a game board upon which the pieces are put into play. A processor may recognize for example a frame of such a game board in a first image and may use the area within the frame to find and detect relevant pieces that are placed into play. In some embodiments, a location of one or more tiles on the game board may be derived. For example, a memory may store an image or other data of placement of special locations on a Scrabble board, and such locations may indicate rules such as double letter score or triple word score that are associated with the locations on the board. The processor may determine a location of a tile placed on the board in the image, and may determine that a tile is in a location on one of such spaces. For example, a processor may determine that a red space of a triple word score is obscured by a tile, and may determine that a tile of a word configuration is located on the triple word score space. The processor may then calculate the value of the word that includes such obscuring tile in accordance with the triple word rule that is stored in memory. Other rules and values may be calculated in accordance with rules stored in a memory, and the letters or tiles configured on a board or playing scene. The calculated values may be added to a score that may be saved in a memory and associated with the player during whose turn the added tiles were detected.

In some embodiments a player may indicate that the imager is to capture an image of tiles that are in his 'kitty' or hand or in reserve and not yet entered into play. A processor may compare words stored in a dictionary in a memory with combinations of one or more tiles in such hand with one or more of the words or configurations of tiles that are in a playing area. A processor may signal the user of a result of such comparison so that a player receives a hint of possible uses of tiles in his hand as opportunities for use of his tiles that can be placed into play on a play area or board.

Embodiments of the invention may include an article such as a computer or processor readable non-transitory storage medium, such as for example a memory, a disk drive, or a USB flash memory device encoding, including or storing instructions, e.g., computer-executable instructions, which when executed by a processor or controller, cause the processor or controller to carry out methods disclosed herein.

It will be appreciated by persons skilled in the art that embodiments of the invention are not limited by what has been particularly shown and described hereinabove. Rather the scope of at least one embodiment of the invention is defined by the claims below.

I claim:

1. A system for interactive gaming, comprising:

an imager to capture a series of images of a plurality of configurations of game tiles on a game board;

a memory to store a set of pre-defined values associated with a set of configurations of said plurality of said game tiles; and a processor to:

detect a first configuration of said plurality of game tiles in a first image of said series of images;

detect a second configuration of said plurality of game tiles in a second image of said series of images;

identify a difference between said first configuration and said second configuration;

calculate a value of said difference in accordance with said set of pre-defined values; and issue a signal of said value of said difference.

2. The system as in claim 1, wherein:

said imager is to capture said series of images of said plurality of said game tiles, said game tiles on a game board; and said processor is to identify a position of a first of said plurality of game tiles relative to a first position on said game board, and to identify a position of a second of said plurality of said game tiles relative to a second position on said game board.

3. The system as in claim 1, wherein:

said memory is to store an indication of a plurality of words, and said processor is to compare said difference between said first configuration and said second configuration with said stored plurality of words; and issue a signal of a result of said comparison.

4. The system as in claim 1, wherein said processor is to add said value of said difference to a value stored in said memory, and to associate a result of said adding with a user.

5. The system as in claim 1, wherein said imager is to capture an image of an item appearing in an image of said series of images, and said processor is to associate said item with a user, and to associate said value of said difference with a value stored in said memory, said value stored in said memory associated with said user.

6. The system as in claim 1, wherein:

said imager is to capture an image of a second plurality of game tiles, and said memory is to store an indication of a plurality of words, and said processor is to:

combine a first of said second plurality of game tiles and said first configuration of said plurality of game tiles;

and compare said combined first of said second plurality of game tiles and said first configuration of said plurality of game tiles to said indication of said plurality of word; and issue a signal of a match of said comparison.

7. A system to calculate a value of playing tiles on a playing board comprising:

an imager to capture an image of said playing board on which are placed said tiles;

a memory to store a rule of play and an association of a first of a plurality of playing tiles with a first pre-defined value; and a processor to:

identify a playing tile on said board in said image, associate said identified playing tile with said first pre-defined value, and calculate a value of said tile in accordance with said rule of play and in accordance with said first value.

8. The system as in claim 7, wherein said memory is to store a score associated with a user, and wherein said processor is to add said calculated value to said score associated with said user.

9. The system as in claim 7, wherein:

said memory is to store a rule associated with a location on said board and said processor is to:

determine a location on said board in said image of a first of said tiles in said image; and calculate said value of said tile under said rule associated with said location on said board.

* * * * *